US005819481A

United States Patent [19]

Wilson

[11] Patent Number: 5,819,481

[45] **Date of Patent: *Oct. 13, 1998**

[54] WALL AND MOLDING PROTECTOR FOR CARPET INSTALLATION

[76] Inventor: Roger D. Wilson, 10635 Winterhawk, Boise, Id. 83709

[21] Appl. No.: 767,891

[22] Filed: Dec. 17, 1996

[ * ] Notice: The term of this patent shall not extend beyond the expiration date of Pat. No. 5,584,149.

Related U.S. Application Data

[62] Division of Ser. No. 500,523, Jul. 11, 1995, Pat. No. 5,584,149.

[51] Int. Cl.[6] ..... E04B 1/00

[52] U.S. Cl. ..... 52/98; 52/287.1; 118/504; 118/505

[58] Field of Search ..... 52/98, 287.1; 118/502, 118/504, 505; 427/282; 428/40, 130, 156

[56] References Cited

U.S. PATENT DOCUMENTS

| | | | |
|---|---|---|---|
| 3,430,402 | 3/1969 | Gaiser | 52/287.1 |
| 3,514,914 | 6/1970 | Bergquist | 52/287.1 |
| 3,633,542 | 1/1972 | Read et al. | 118/505 |
| 3,693,589 | 9/1972 | Knox | 118/504 |
| 3,752,304 | 8/1973 | Alef | 118/505 |
| 4,051,808 | 10/1977 | Trupp | 118/504 |
| 4,263,355 | 4/1981 | Sarkisian | 428/124 |
| 4,357,898 | 11/1982 | Fehrenbacher | 118/505 |
| 4,536,913 | 8/1985 | Morowski | 118/504 |
| 4,564,970 | 1/1986 | Latraverxe | 118/504 |
| 4,835,026 | 5/1989 | Horiki et al. | 428/40 |
| 5,014,486 | 5/1991 | Mayle | 52/288.1 |
| 5,040,346 | 8/1991 | White | 52/288.1 |
| 5,164,238 | 11/1992 | Horiki et al. | 118/505 |
| 5,184,445 | 2/1993 | Hoopengardner | 52/287.1 |
| 5,230,738 | 7/1993 | Wheeler | 118/505 |
| 5,584,149 | 12/1996 | Wilson | 52/98 |

FOREIGN PATENT DOCUMENTS

| | | | |
|---|---|---|---|
| 0366514 | 5/1990 | European Pat. Off. | A47K 10/16 |
| 2198941 | 6/1988 | United Kingdom | A47G 27/00 |
| 2290993 | 1/1996 | United Kingdom | B05C 21/00 |

*Primary Examiner*—Beth A. Aubrey
*Attorney, Agent, or Firm*—Ken J. Pedersen; Barbara S. Pedersen

[57] ABSTRACT

A carpet layer's aid for protecting floor baseboards or walls during carpet installation, the aid including an elongated strip which can be separated into two portions. The elongated strip is separated into an edge portion, which is used to anchor the elongated strip, and a central portion, which is used to shield the baseboard or wall. Preferably, the elongated strip has perforations which allow the central portion to be detached from the edge portion of the elongated strip upon completing the carpet installation. The edge portion of the elongated strip is left behind under the tack strip and carpet.

20 Claims, 4 Drawing Sheets

WALL AND MOLDING PROTECTOR FOR CARPET INSTALLATION

DESCRIPTION

This application is a divisional application of my prior, application, WALL AND MOLDING PROTECTOR FOR CARPET INSTALLATION, Ser. No. 08/500,523, filed on Jul. 11, 1995, issued as U.S. Pat. No. 5,584,149 on Dec. 17, 1996.

BACKGROUND

1. Field of the Invention

This invention relates generally to protecting floor baseboards or walls from damage during the installation of wall-to-wall carpet. More specifically, this invention relates to a temporary baseboard or wall protector which is easily and quickly removable after the carpet is installed.

2. Description of the Related Art

U.S. Pat. No. 4,263,355 (Sarkisian) discloses an elongated plastic, L-shaped paint shield for protecting the edge of a carpet or floor while painting walls. This shield was intended to protect carpeting already in place prior to painting the wall. In addition, the paint shield is completely removed upon completing the painting.

U.S. Pat. No. 3,633,542 (Read et al.) discloses a plastic paint shield having a curved longitudinal edge that is inserted between the edge of the carpet and the baseboard during painting. The Read et al. shield also has a longitudinal central portion for covering and protecting the edge and the top surface of the carpet from paint damage. This shield is also intended to be completely removed when the painting is complete.

The disclosed invention fulfills a previously unmet need by allowing carpet to be installed easily and quickly without damaging walls or existing baseboards. Neither the Sarkisian nor the Read et al. patents contemplated a use other than protecting existing carpet or flooring from paint. In addition, upon completing the carpet installation, a small portion of the disclosed invention is left behind under the carpet, unlike the prior art devices which are completely removed.

SUMMARY OF INVENTION

The present invention is a carpet layer's aid for protecting floor baseboards, walls, of other building surfaces during carpet installation. The protector comprises an elongated strip of sheet material with a separating means. The elongated strip is generally flat and is divided into a shield portion and an anchor portion by the separating means, which may be an elongated perforation. The separating means is integral with the elongated strip and allows the shield portion to be separated from the anchor portion of the elongated strip upon completion of the carpet installation. In use, the elongated strip is folded along the separating means into a general L shape. The shield portion of the elongated strip extends upwardly protecting the baseboard or wall. At the same time, the anchor portion of the elongated strip extends horizontally outward from the baseboard or wall. After carpet installation, the anchor portion is left behind under the tack strip and carpet after the shield portion is removed using the separating means. The anchor portion is hidden by the carpet and remains in place until the carpet is replaced.

During the installation of a carpet, the elongated strip provides an economical and convenient way of protecting the building surfaces that are adjacent to the edge of the carpet. Because the anchor portion is secured under the carpet, and preferably under the tack strip, and the shield portion extends out from the carpet and over the building surface adjacent to the carpet, the building surface is protected from scratches and gouges that can otherwise result from the stretching, cutting, and tucking of the carpet.

DESCRIPTION OF THE PREFERRED EMBODIMENT

Figures 1, 2, 3:
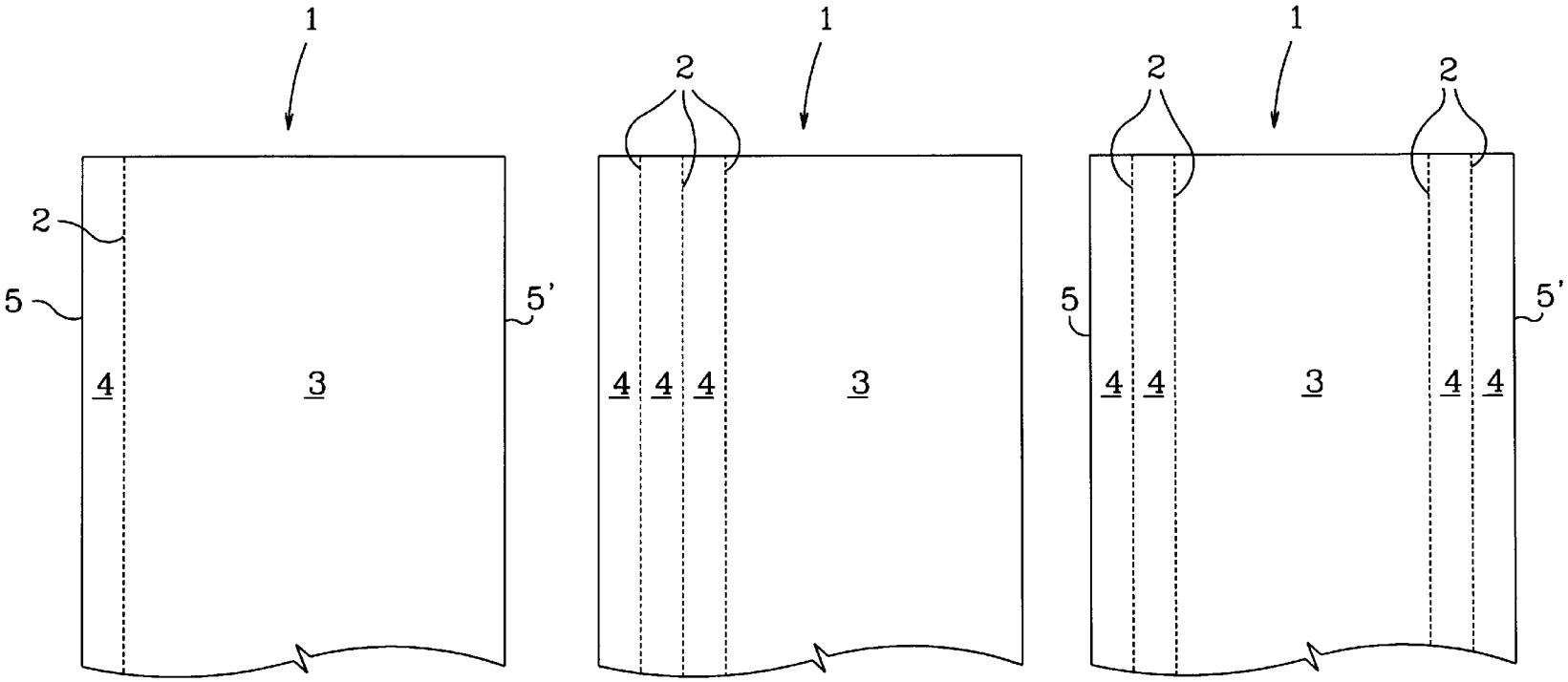
FIG. 1 is a partial top view of an embodiment of the invention having an elongated perforation as the separating means.
FIG. 2 is a partial top view of an alternative embodiment having multiple perforations along only one longitudinal edge, which allow the protector to be reused.
FIG. 3 is a partial top view of an alternative embodiment having multiple perforations along both longitudinal edges.

The disclosed invention is a carpet layer's aid for protecting floor baseboards or walls during carpet installation. The aid comprises a generally flat, elongated strip (1) of sheet material, for example fiberboard or cardboard, having approximately a 90 or 120 pound weight. The specific type of sheet material used is not important. The sheet material must be thick enough to protect the baseboard or wall from accidental marks, and thin enough to be folded and separated using the separating means (2). The elongated strip (1) is preferably 5 to 9 inches wide and about 48 inches long, for convenience of installation and to match the length of the typical tack strip (6). Preferably, the elongated strip has greater than a 5/1 ratio of length to width. Other sizes of elongated strip (1) may be used, however, the elongated strip (1) must be sufficiently wide, so that, when it is folded at the separating means (2), the upwardly extending shield portion (7) is tall enough to protect the baseboard or bottom of the wall while carpet is being laid. An alternative embodiment may be of the same width as the precut embodiments, but in bulk roll lengths.

Integral with the elongated strip (1) is a separating means (2) formed by a series of perforations generally parallel to and near at least one longitudinal edge (5, 5') of the elongated strip (1). (See FIGS. 1–3) Multiple separating means (2) allow this invention to be reused until it is no longer a sufficient width to protect the baseboard or wall. All of the separating means may be located along one longitudinal edge (5) (See FIG. 2) or the separating means may be divided between the two longitudinal edges (5, 5') of the elongated strip (See FIG. 3). Locating the multiple separating means along one longitudinal edge or another does not effect the function of the protector.

Figure 5:
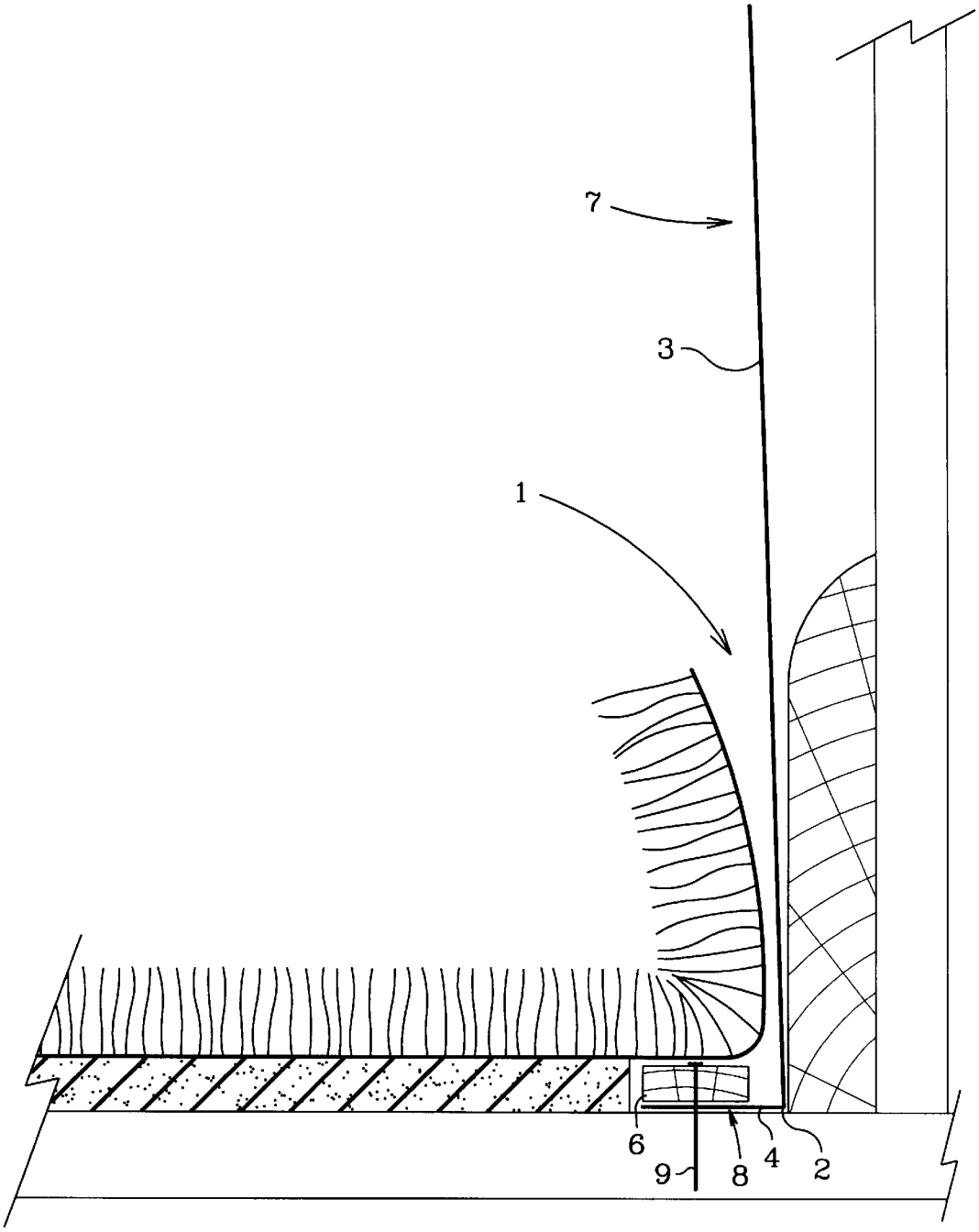
FIG. 5 is a cross sectional view of the embodiment of the invention of FIG. 1 in use before the carpet is trimmed.
Figure 6:
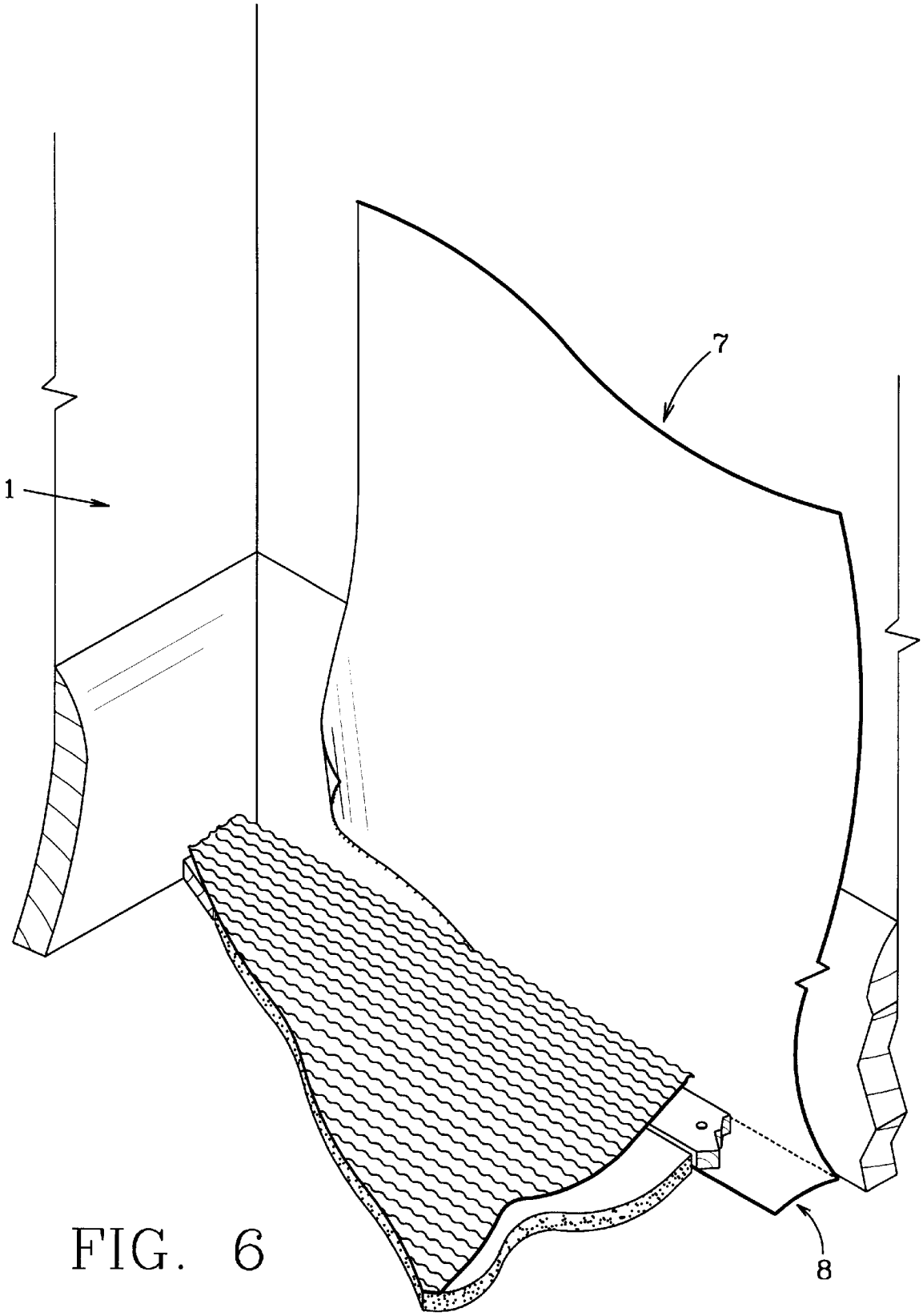
FIG. 6 is a perspective view of the embodiment of the invention of FIG. 1, wherein the central portion of the carpet layer's aid is being removed after installation of the carpet is complete.

Referring to FIGS. 1, 5, and 6, the separating means (2) divides the elongated strip (1) into a central portion (3) and one edge portion (4), which in this embodiment are the shield portion (7) and anchor portion (8), respectively. The separating means (2) also provides a way for the elongated strip (1) to be folded into a generally L-shaped configuration. After folding along the separating means (2), the edge portion (4) is placed on the floor and extends horizontally outward from the baseboard or wall until it is under the tack strip (6). At the same time, the central portion (3) extends vertically upward and protects the baseboard or wall. (See FIG. 5).

Again referring to FIGS. 1, 5 and 6, the invention provides protection during the carpet installation by allowing the carpet layer to stretch, trim, and tuck the carpet along the baseboard or wall without damaging the finish. After the carpet is installed, the carpet layer can pull on the vertical central portion (3) of the elongated strip (1), causing the folded separating means (2) to allow the central portion (3) to be pulled free and separate from the horizontal edge portion (4). The horizontal edge portion (4), after separation from central portion (3), is left behind out of sight under the tack strip and newly installed carpet and remains in place until the carpet is replaced.

The separating means (2) may comprise a series of perforations. The size of the perforations and exact pattern is not critical. The important characteristic is that the separating means (2) allows the central portion (3) to be separated from the horizontal edge portion (4) of the elongated strip (1). The perforations are generally parallel to the elongated strip's (1) longitudinal axis. (See FIGS. 1–3) Each separating means (2) is approximately 1–3 inches from a longitudinal edge of the elongated strip (1). The only requirements the separating means (2) must meet are that it define an edge portion large enough to extend horizontally from the baseboard or wall to beneath the tack strip, and that it allow the central portion (3) to extend vertically past the top of the baseboard during use, and, after use, to be pulled free of the horizontal edge portion (4) without displacing the newly installed carpet. (See FIG. 6)

An alternate embodiment utilizes a separating means comprising an adhesive. In such an embodiment, the edge portion (4) and central portion (3) are separate pieces of sheet material that overlap slightly and are temporarily held together by adhesive. The adhesive is designed to allow the central portion (3) to be detached from the edge portion (4) with moderate force and without tearing of the sheet material, after the carpet installation is completed.

Embodiments of the elongated strip (1) that have a plurality of edge portions (4) and a plurality of separating means (2), are also used by the method shown in FIGS. 5 and 6. For these embodiments, a single, outermost edge portion (4) typically is secured under the tack strip (6) and the elongated strip (1) is folded into an L-shape at the corresponding outermost separating means (2), so that the outermost edge portion becomes the horizontal anchoring portion (8) and the remaining edge portions and the central portion (3) become the vertical shield portion (7). After the first use, the embodiments in FIG. 2 and 3 have one fewer edge portion (4), and, for the next use, a new fold is made at the new outermost separating means (2) to make the new outermost edge portion (4) the anchoring portion (8). Thus, the embodiment of FIG. 2 may be used three times and the embodiment of FIG. 3 may be used four times, corresponding to the three and four edge portions (4) of the embodiments, respectively.

This invention can be used with existing tack strips or when installing new tack strips. Where new tack strips are being used, the tack strips (6) can be nailed directly onto the horizontal edge portion (4) of the elongated strip (1), as shown in FIGS. 5 and 6. When existing tack strips are being used, the tack strips may be lifted or pried up enough to slide the elongated strip underneath the tack strip, and the tack strip may be retightened by pounding the existing nails (9) or, preferably, by pounding in new nails through the existing tack strip and the elongated strip (1). Preferably, the elongated strip (1) is secured between the tack strip and the floor or other building surface by frictional engagement and by nails or other fasteners extending through the tack strip, elongated strip, and into the floor. Optionally, the elongated strip (1) may be secured under the tack strip only by frictional engagement. The invented strip (1) and method of using the strip (1) also include any embodiments in which the strip (1) is secured underneath the carpet by a variety of means, even those which do not include the use of a tack strip.

Figure 4:
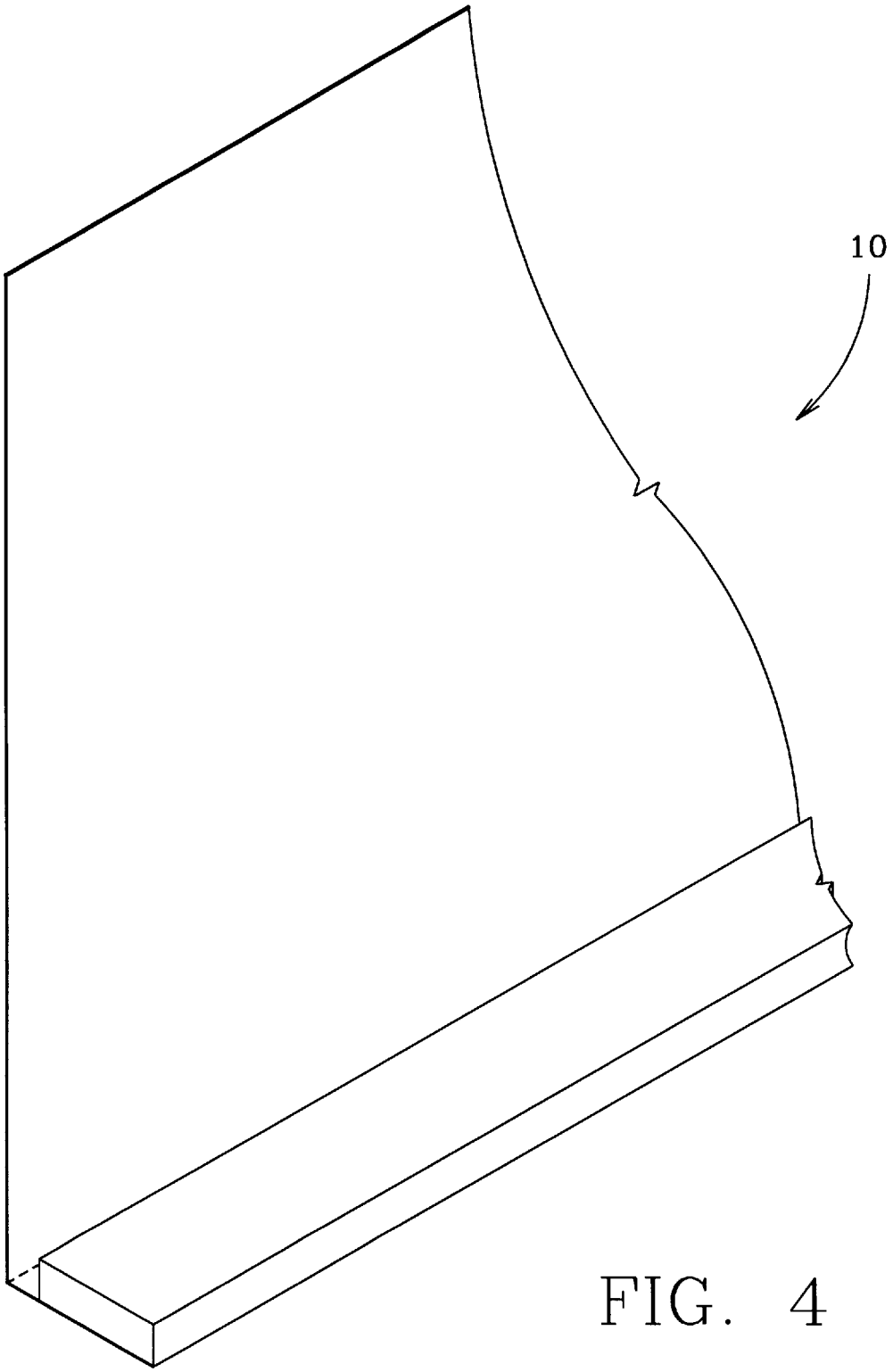
FIG. 4 is a perspective view of an alternative embodiment having a tack strip integral with the elongated strip.

An alternate embodiment of this invention includes a tack strip integral with the elongated strip (1). (See FIG. 4). This embodiment utilizes a similar elongated strip and separating means as previously discussed. However, in this embodiment the outermost horizontal edge portion (4) is secured to the tack strip by being integral with the tack strip. For example, a thin plastic strip (1) may extend integrally from a plastic tack strip, or a fiberboard strip (1) may extend from a thick fiberboard tack strip. Or, an elongated strip (1) may be glued around the tack strip (6) during manufacture. The resulting tack strip—elongated strip combination (10) is easy to handle and use.

An added feature that may be included in an alternate embodiment is a tack strip indexing means, for example, a notch or a mark, that is integral with the edge portion (4). An indexing means enables the carpet layer to consistently locate the tack strip at the preferred distance from the baseboard or wall.

Although the preferred use of the invented elongated strip (1) is for protecting vertical baseboards or walls during carpet installation, the invention also includes use of the strip (1) on any building surface and for installation of any floor covering. Thus, the invention includes any embodiment wherein the anchor portion is secured or connected to a first area of the building surface and the shield portion extends out from under the edge of the floor covering to protect an adjacent second area of the building surface.

Although this invention has been described above with reference to particular means, materials and embodiments, it is to be understood that the invention is not limited to these disclosed particulars, but extends instead to all equivalents within the scope of the following claims.

What is claimed is:

1. A carpet layer's aid, for protecting a building surface during installation of carpet, comprising:

a single elongated strip of sheet material having a longitudinal axis, a longitudinal anchor portion for being secured under a carpet, and a longitudinal shield portion for extending out from under the carpet to protect the building surface; and at least one means, integral with said elongated strip, for separating said elongated strip into two pieces, said anchor portion and said shield portion, and leaving said anchor portion of said elongated strip under the carpet upon completion of the carpet installation, wherein said separating means are all generally parallel to the longitudinal axis of the elongated strip; and wherein the single elongated strip is bent at the separating means between said anchor portion and said shield portion and is generally L-shaped.

2. The carpet layer's aid, as recited in claim 1, wherein said elongated strip further has two longitudinal edges.

3. The carpet layer's aid, as recited in claim 2, further having only one said separating means, said separating means being located near one of said longitudinal edges of said elongated strip.

4. The carpet layer's aid, as recited in claim 2, further comprising a plurality of separating means integral with said elongated strip, at least one of said plurality of separating means being located near each of said longitudinal edges.

5. The carpet layer's aid, as recited in claim 2, further comprising a plurality of separating means integral with said elongated strip, wherein said plurality of separating means are located near one of said two longitudinal edges, and no separating means are located near the other of said two longitudinal edges.

6. The carpet layer's aid as in claim 1, wherein said separating means comprises perforations in said elongated strip.

7. The carpet layer's aid as in claim 1, wherein said elongated strip is cardboard.

8. The carpet layer's aid, for protecting a building surface during installation of carpet, comprising:

an elongated strip of sheet material having a length and a width, a longitudinal axis, two longitudinal edges, a longitudinal anchor portion for being secured under a carpet, and a longitudinal shield portion for extending out from under the carpet to protect the building surface; and at least one means, integral with said elongated strip, for separating said elongated strip into two pieces, said anchor portion and said shield portion, and leaving said anchor portion of said elongated strip under the carpet upon completion of the carpet installation;

wherein said elongated strip has a length/width ratio of greater than 5/1; and wherein said elongated strip is bent at the separating means between said anchor portion and said shield portion to be generally L-shaped.

9. The carpet layer's aid as in claim 8, wherein said separating means comprises perforations in said elongated strip.

10. The carpet layer's aid as in claim 8, wherein said separating means comprises adhesive.

11. The carpet layer's aid as in claim 8, further having only one separating means located near one of said longitudinal edges.

12. The carpet layer's aid as in claim 8, further comprising a plurality of separating means, at least one of said plurality of separating means being located near each of said longitudinal edges.

13. The carpet layer's aid as in claim 8, further comprising a plurality of separating means located near one of said two longitudinal edges, and no separating means located near the other of said two longitudinal edges.

14. The carpet layer's aid as in claim 8, wherein said separating means are all parallel to said longitudinal axis of said elongated strip.

15. The carpet layer's aid as in claim 8, comprising a single elongated strip of sheet material.

16. A carpet layer's system, for protecting a building surface during installation of carpet, the system comprising:

a carpet having a carpet edge;

a single elongated strip of sheet material having a longitudinal axis, a longitudinal first portion extending underneath said carpet near the carpet edge and a longitudinal second portion extending out from under the carpet to extend up near the building surface; and a line of perforations in said elongated strip between said first portion and said second portion and parallel to the longitudinal axis.

17. The carpet layer's system as recited in claim 16, wherein the elongated strip is bent at the separating means between the first portion and second portion to be generally L-shaped.

18. The carpet layer's system, as recited in claim 16, wherein the first portion is secured under the carpet edge.

19. A carpet layer's aid, for protecting a building surface during installation of carpet, the aid comprising:

a single elongated strip of sheet material having a longitudinal axis, a longitudinal first portion for being under a carpet, and a longitudinal second portion for extending out from under the carpet to protect the building surface; and a line of perforations in said elongated strip between said first portion and said second portion, wherein said line of perforations is generally parallel to the longitudinal axis of the elongated strip; and wherein the single elongated strip is bent at said line of perforations between said first portion and said second portion to be generally L-shaped.

20. The carpet layer's aid, as recited in claim 19, further comprising a plurality of lines of perforations, all of said lines being parallel to said longitudinal axis.

* * * * *